US006688598B1

(12) United States Patent
Hsi

(10) Patent No.: US 6,688,598 B1
(45) Date of Patent: Feb. 10, 2004

(54) METHOD OF PLAYING A WAGERING GAME

(76) Inventor: Chen Shein Hsi, 9289 Scenic Mountain La., Las Vegas, NV (US) 89117

( * ) Notice: Subject to any disclaimer, the term of this patent is extended or adjusted under 35 U.S.C. 154(b) by 0 days.

(21) Appl. No.: 10/199,647

(22) Filed: Jul. 19, 2002

Related U.S. Application Data

(63) Continuation-in-part of application No. 09/888,168, filed on Jun. 23, 2001, now abandoned.

(51) Int. Cl.[7] ..... A63F 1/00

(52) U.S. Cl. ..... 273/292; 273/274; 273/303; 273/306; 273/309; 463/11; 463/12; 463/13

(58) Field of Search ..... 273/292, 503, 273/274, 309, 306; 463/13, 12, 11

(56) References Cited

U.S. PATENT DOCUMENTS

| | | | | | |
|---|---|---|---|---|---|
| 5,248,142 | A | * | 9/1993 | Breeding | 273/138.1 |
| 5,452,900 | A | * | 9/1995 | Skratulia et al. | 273/292 |
| 5,494,295 | A | * | 2/1996 | Potter et al. | 273/292 |
| 5,522,595 | A | * | 6/1996 | Wong | 273/292 |
| 5,645,281 | A | * | 7/1997 | Hesse et al. | 273/292 |
| 5,690,335 | A | * | 11/1997 | Skratulia | 273/292 |
| 5,725,215 | A | * | 3/1998 | Hesse | 273/292 |
| 5,803,460 | A | * | 9/1998 | Hesse | 273/292 |
| 5,879,007 | A | * | 3/1999 | Kasri | 273/292 |
| 6,196,548 | B1 | * | 3/2001 | Schaefer | 273/292 |
| 6,273,423 | B1 | * | 8/2001 | Promutico | 273/274 |
| 6,336,858 | B1 | * | 1/2002 | Yoseloff | 463/13 |
| 6,457,715 | B1 | * | 10/2002 | Friedman | 273/274 |
| 6,550,772 | B1 | * | 4/2003 | Hsi et al. | 273/292 |

OTHER PUBLICATIONS

Streeks et al. —Pub. No.: US 2003/0062677 A1—Apr. 3, 2003 —Method of Playing a Wagering Game and Apparatus Therefor.*

R. Dunn —Pub. No.: US 2002/0195773 A1 —Method of Playing a Table Card Game with Electronic Multiplier Bonus Feature Ans Apparatus for Playing The Game —Dec. 26, 2002.*

Webb et al. —Pub No.: US 2002/0153662 A1 —Player Banked Three Card Poker and Associated Games —Oct. 24, 2002.*

F. Zahedi —Pub. No.: US 2001/0040344 A1 —Card Game and Method of Play —Nov. 15, 2001.*

J. Hartl —Pub. No.: US 2003/0008697 A1 —Combination Wagering Game —Jan. 9, 2003.*

R. Snow —Pub. No.: US 2003/0042679 A1 —Method of Playing a Three Part Wagering Game with Bonus for Consecutive Wins —Mar. 6, 2003.*

L. Cannon —Pub. No.: US 2002/0025845 A1 —Method of Playing a Dual Wagering Game —Feb. 28, 2002.*

Yoseloff et al. —Pub. No.: US 2002/0074726 A1 —Method of Playing a Table Card Game with Electronic Multiplier Bonus Feature ans Apparatus for Playing the Game —Jun. 20, 2002.*

* cited by examiner

*Primary Examiner*—Steven Wong
*Assistant Examiner*—Dolores R. Collins
(74) *Attorney, Agent, or Firm*—Ted Masters

(57) ABSTRACT

A method of playing a wagering game includes providing a set of 30 numerical playing pieces. The set includes three 1's, three 2's, three 3's, three 4's, three 5's, three 6's, three 7's, three 8's, three 9's, and three 0's (zeros). A banker is selected before each round of play. Each player, except the banker, makes a conventional wager. Each player except a participating house dealer can optionally make supplemental bonus wager. After the house dealer distributes three playing pieces to each player, the players set a two playing piece hand and discard the third playing piece. The banker then compares hands and settles wagers with each player. The hand having the highest pair wins (a pair of zero's highest and a pair of 1's lowest), else the playing pieces in each hand are summed and the sum having the highest least significant digit (LSD) wins (nine being highest and zero being lowest). A bonus payoff is made by the house if the three dealt playing pieces are: three of a kind, add to 9 or 19, or contain a pair.

5 Claims, 4 Drawing Sheets

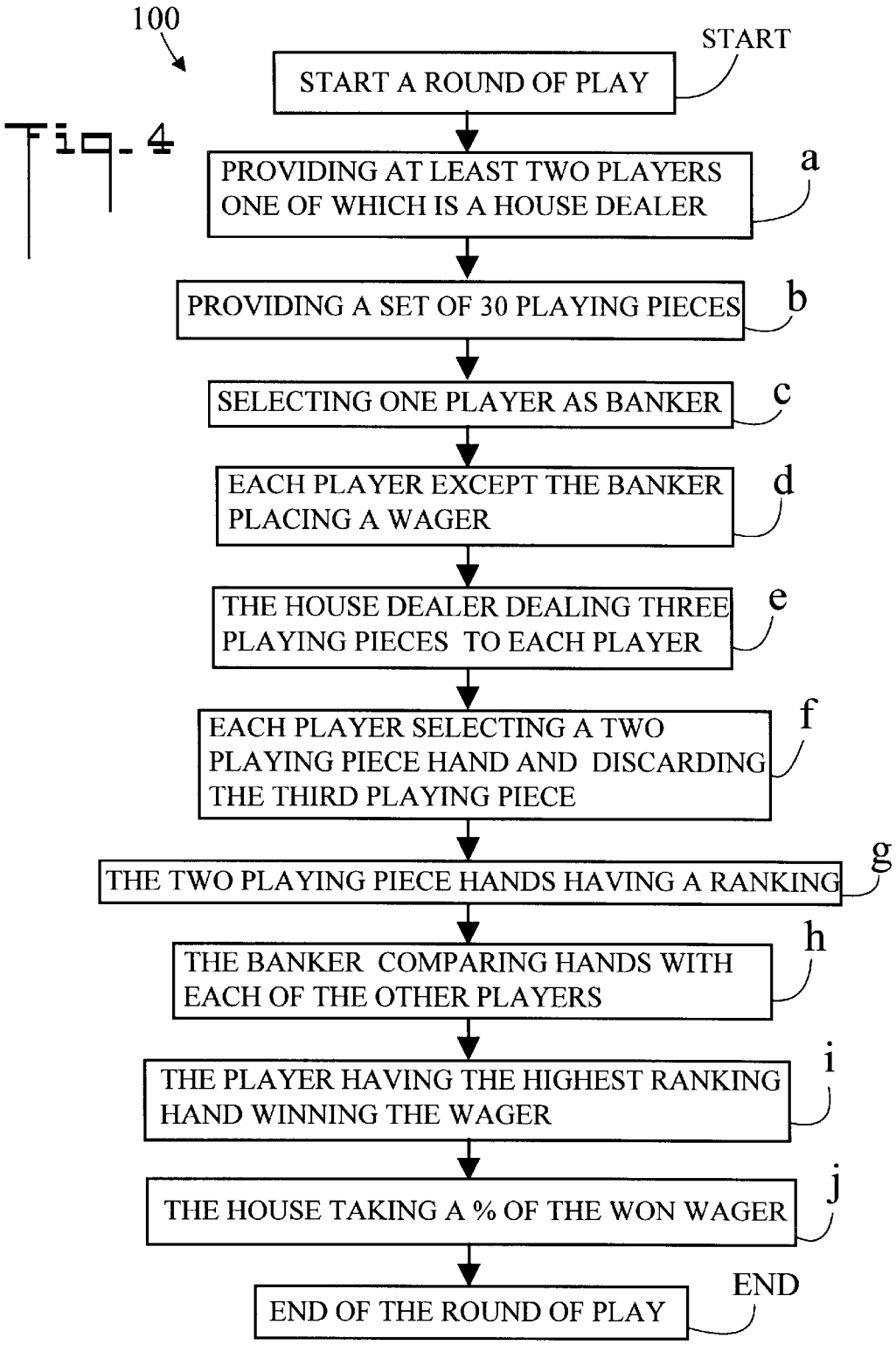
100
Fig. 4
START
START A ROUND OF PLAY
a
PROVIDING AT LEAST TWO PLAYERS ONE OF WHICH IS A HOUSE DEALER
b
PROVIDING A SET OF 30 PLAYING PIECES
c
SELECTING ONE PLAYER AS BANKER
d
EACH PLAYER EXCEPT THE BANKER PLACING A WAGER
e
THE HOUSE DEALER DEALING THREE PLAYING PIECES TO EACH PLAYER
f
EACH PLAYER SELECTING A TWO PLAYING PIECE HAND AND DISCARDING THE THIRD PLAYING PIECE
g
THE TWO PLAYING PIECE HANDS HAVING A RANKING
h
THE BANKER COMPARING HANDS WITH EACH OF THE OTHER PLAYERS
i
THE PLAYER HAVING THE HIGHEST RANKING HAND WINNING THE WAGER
j
THE HOUSE TAKING A % OF THE WON WAGER
END
END OF THE ROUND OF PLAY

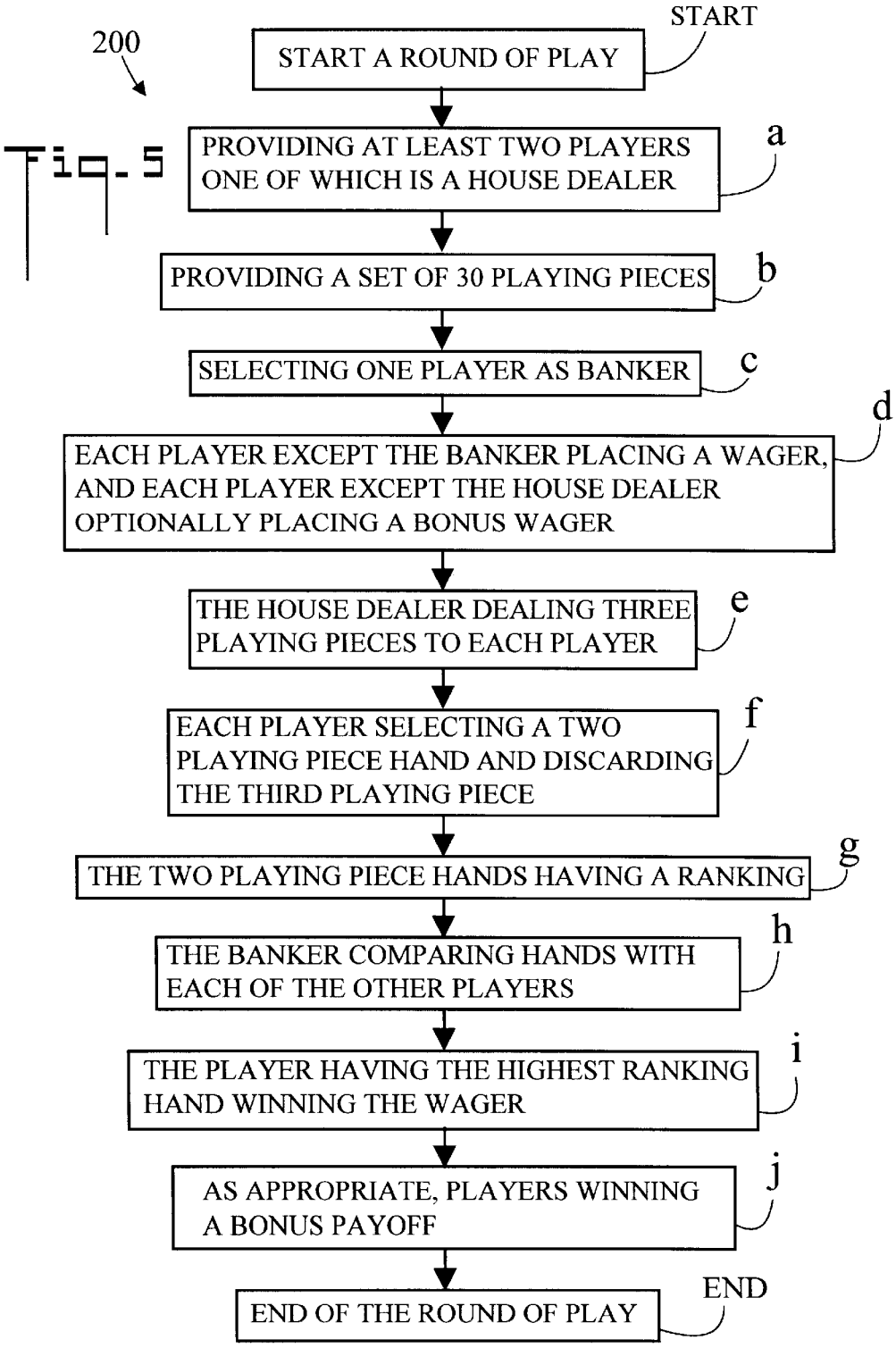
200
Fig. 5
START
START A ROUND OF PLAY
a
PROVIDING AT LEAST TWO PLAYERS ONE OF WHICH IS A HOUSE DEALER
b
PROVIDING A SET OF 30 PLAYING PIECES
c
SELECTING ONE PLAYER AS BANKER
d
EACH PLAYER EXCEPT THE BANKER PLACING A WAGER, AND EACH PLAYER EXCEPT THE HOUSE DEALER OPTIONALLY PLACING A BONUS WAGER
e
THE HOUSE DEALER DEALING THREE PLAYING PIECES TO EACH PLAYER
f
EACH PLAYER SELECTING A TWO PLAYING PIECE HAND AND DISCARDING THE THIRD PLAYING PIECE
g
THE TWO PLAYING PIECE HANDS HAVING A RANKING
h
THE BANKER COMPARING HANDS WITH EACH OF THE OTHER PLAYERS
i
THE PLAYER HAVING THE HIGHEST RANKING HAND WINNING THE WAGER
j
AS APPROPRIATE, PLAYERS WINNING A BONUS PAYOFF
END
END OF THE ROUND OF PLAY

METHOD OF PLAYING A WAGERING GAME

CROSS REFERENCE TO RELATED APPLICATION

This application is a Continuation in Part of application Ser. No. 09/888,168, filed Jun. 23, 2001, now abandoned.

TECHNICAL FIELD

The present invention pertains generally to wagering games, and more particularly to a wagering game between players using 30 numerical playing pieces. The object of the game is to form the highest ranking two playing piece hand.

BACKGROUND OF THE INVENTION

Mah Jongg (Majong) is a game of Chinese origin which is played with a set of playing tiles which are engraved or painted with designs and numerals. A full set contains 152 playing pieces which are divided into seven suits. American Majong sets usually have 166 tiles. The game is usually played by four people which take the name and position of one of the four winds; North, East, South, and West.

Pai Gow Chinese Dominoes is a derivative of Majong which is played in gaming Casinos, and is a predecessor of the modern games of Chemin de Fer, Baccarat, and Blackjack. The game uses a set of 32 tiles or dominoes. In one embodiment of the game the bank can either reside with the participating house dealer or with one of the players. The house dealer always banks the first hand. After the first hand, the house dealer will sequentially offer the bank to each of the players in a counterclockwise direction until (1) a player accepts the bank, or (2) no player accepts the bank and it reverts back to the house dealer. The house collects a 5% commission on all winning bets.

U.S. Pat. No. 5,522,595 discloses a method of playing a wagering game wherein wagers are apportioned between a plurality of game players and a player-banker. Play includes the placing of wagers by the players, and the establishment of a bank by the player-dealer. Each player and the player-banker are dealt three playing tiles from which they select the highest ranking two tile hand. The player-banker then sequentially compares his/her hand with each of the player's hands and pays or takes the wager depending upon whether the player's hand is higher ranking than the player-banker's hand. The game may be played with either 24 or 32 tiles.

SUMMARY OF THE INVENTION

The present invention is directed to a rotating bank game that uses a partial set of 30 Mahjong playing pieces. There is a house dealer (who represents the house or casino) and one to seven other outside players. The house dealer may be the banker for a round of play, or an outside player may be the banker. The players place a regular (conventional) wager and have the option of placing a separate side wager, known as a "bonus wager". The game is similar to playing Baccarat, with nine points being the highest, except for matching pairs, in which case zero is the highest. Each playing piece has a ranking determined by a numerical value marked on its face. The playing pieces are ranked from highest to lowest 0(zero), 9, 8, 7, 6, 5, 4, 3, 2, 1. The winner is the person with the highest ranking two playing pieces. A preferred name for the game of the present invention is San Tsai.

The house dealer starts the game by randomizing the playing pieces (washing for tiles, shuffling for cards, etc.). The playing pieces are then placed in ten groups containing three playing pieces each. Dice are then rolled to determine which group of playing pieces is dealt (distributed) first. The house dealer then hands the playing pieces out counterclockwise, beginning with the banker. Each player receives three playing pieces. The player keeps the two playing pieces that either: (1) pair up with a high ranking close or equal to nine, or (2) when added together total close or equal to nine (subtracting multiples of ten as in Baccarat). The unused third playing piece is discarded.

If both the player and the banker have the same numerically valued hand, then the hand with the highest ranking playing piece wins. If both the player and the banker have exactly the same hand (a push), then the banker wins.

The house collects 5% commission on winning wagers, except bonus wagers.

The present invention has the following useful features:

1. 30 playing pieces of ten types are used thereby resulting in:
   - a more symmetrical game (v. 24 or 32 playing pieces)
   - ten stacks of three playing pieces
   - three each of ten types of playing pieces is less confusing than games having odd non-numeric (character) playing piece types
   - only one type zero value playing piece is used
2. Banking method is more flexible:
   - player has option of banking or not
   - accommodates players who do not wish to play against their friends
   - allows the banker to take pushes thereby increasing winnings
3. Bonus Wager:
   - more exciting
   - allows large payoff for three of a kind
   - allows payoff for three playing pieces which sum to 9 or 19
   - allows payoff for two of a kind
4. Plays faster therefore making more money for the house
   - skilled fast dealer is always matching hands and making payoffs
   - no need to determine action player as in California games
   - no need for the banker to place a wager In accordance with a preferred embodiment of the invention, a method of playing a wagering game, comprises:

(a) providing a plurality of players one of which is a house dealer;

(b) providing a set of 30 playing playing pieces, the set including three playing pieces having a numerical value of one, three playing pieces having a numerical value of two, three playing pieces having a numerical value of three, three playing pieces having a numerical value of four, three playing pieces having a numerical value of five, three playing pieces having a numerical value of six, three playing pieces having a numerical value of seven, three playing pieces having a numerical value of eight, three playing pieces having a numerical value of nine, and three playing pieces having a numerical value of zero;

(c) selecting one of the players to be a banker who will play against the other players;

(d) each of the players except the selected banker placing a wager;

(e) the house dealer dealing a three playing piece hand to each of the players;

(f) each of the players setting his or her hand by selecting two of the three playing pieces to form a two playing piece hand and discarding the third playing piece;

(g) the ranking of the two selected playing pieces including from highest to lowest:
- two zero value playing pieces;
- two nine value playing pieces;
- two eight value playing pieces;
- two seven value playing pieces;
- two six value playing pieces;
- two five value playing pieces;
- two four value playing pieces;
- two three value playing pieces;
- two two value playing pieces;
- two one value playing pieces;
- two different value playing pieces which when summed result in a LSD of nine;
- two different value playing pieces which when summed result in a LSD of eight;
- two different value playing pieces which when summed result in a LSD of seven;
- two different value playing pieces which when summed result in a LSD of six;
- two different value playing pieces which when summed result in a LSD of five;
- two different value playing pieces which when summed result in a LSD of four; and,
- two different value playing pieces which when summed result in a LSD of three;

(h) the banker sequentially comparing hands with each of the other players;

(i) in each step (h) comparison, the player having a highest ranking hand as defined in step (g) wins the wager of the other player; and, (j) (1) if the house dealer is banker, a fixed percentage of each conventional wager won in step (i) goes to the house dealer, or (2) if an outside player is banker, a fixed percentage of the banker's net winnings (excluding bonus wager winnings or losings) from step (i) goes to the house dealer.

In accordance with an aspect of the invention, either the house dealer or an outside player may be the banker.

In accordance with another aspect of the invention, each player except the house dealer may optionally place a bonus wager, wherein a house bonus payoff is awarded for (1) three like playing pieces, (2) three playing pieces which sum to 9 or 19, and (3) two like playing pieces.

In accordance with another aspect of the invention, in step (c) after each round of play wherein a player other than the house dealer was banker, the banker role being sequentially offered to each other player until one player accepts, else the house dealer becoming banker for a next round of play.

Other aspects of the present invention will become apparent from the following detailed description, taken in conjunction with the accompanying drawings, which illustrate, by way of example, the principles of the invention.

BRIEF DESCRIPTION OF THE DRAWINGS

FIG. 4 is a flow diagram illustrating the method of playing the wagering game of the present invention; and, FIG. 5 is a flow diagram of a second embodiment.

DETAILED DESCRIPTION OF THE INVENTION

Figure 1:
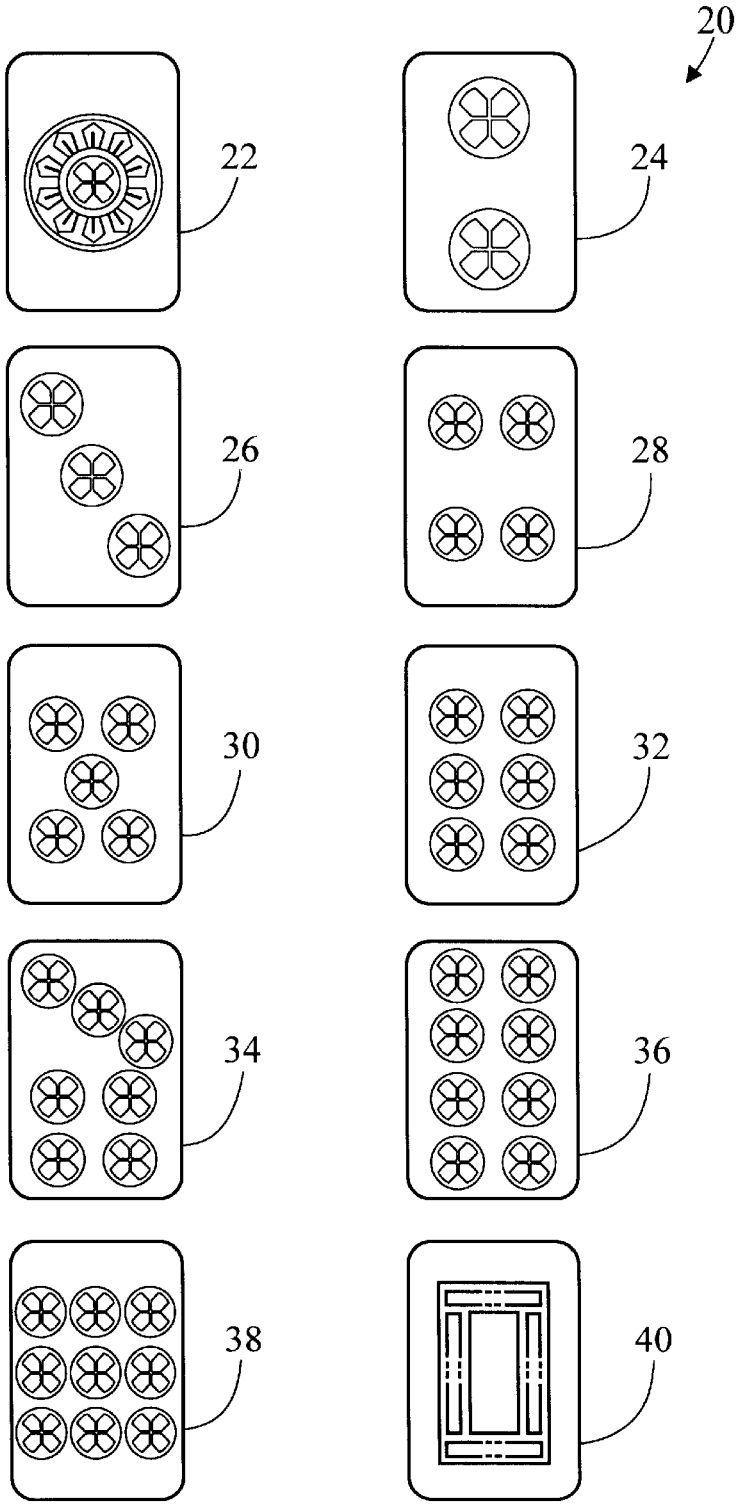
FIG. 1 is a top plan view of the ten different playing piece types of the present invention.

Referring initially to FIG. 1, there is illustrated a top plan view of the ten different playing piece types of the present invention, generally designated as 20. Three such groups of ten playing pieces 20 comprise a 30 playing piece set of the present invention. The 30 playing piece set includes three playing pieces 22 having a numerical value of one, three playing pieces 24 having a numerical value of two, three playing pieces 26 having a numerical value of three, three playing pieces 28 having a numerical value of four, three playing pieces 30 having a numerical value of five, three playing pieces 32 having a numerical value of six, three playing pieces 34 having a numerical value of seven, three playing pieces 36 having a numerical value of eight, three playing pieces 38 having a numerical value of nine, and three playing pieces 40 having a numerical value of zero (0). The face of the playing pieces 20 are engraved, painted, or otherwise marked with the ten numerical values, and each playing piece has a common reverse side. It may be appreciated that other forms of marking could be utilized, so long as each of the numerical values one though zero are depicted. In terms of playing piece ranking, the zero playing piece 40 is highest ranking, followed by the nine playing piece 38, eight playing piece 36, etc., with the one playing piece 22 being the lowest ranked. That is, the ranking order is 0, 9, 8, 7, 6, 5, 4,3,2, and 1.

It may be appreciated that the set of 30 playing pieces may comprise a set of 30 playing tiles, a deck of 30 playing cards, or any other set of 30 playing pieces marked as described above.

Figure 2:
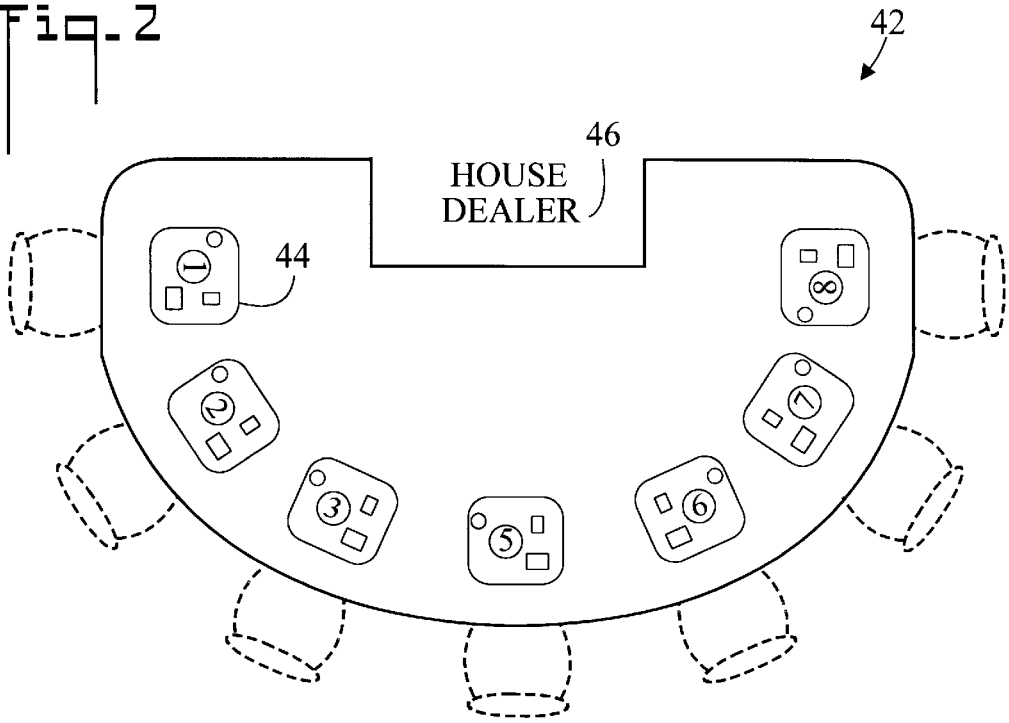
FIG. 2 is a top plan view of a playing table layout.

FIG. 2 is a top plan view of a playing table layout 42. Layout 42 includes places for seven players (outside players) wherein each player has a playing area 44. Layout 42 also includes a place 46 for a participating house dealer. In the present invention, the house dealer is also a participating player. It is noted that for cultural reasons, the playing positions are arranged in counterclockwise order, and the number four which is considered to be unlucky by many Chinese people, is omitted from the layout.

Figure 3:
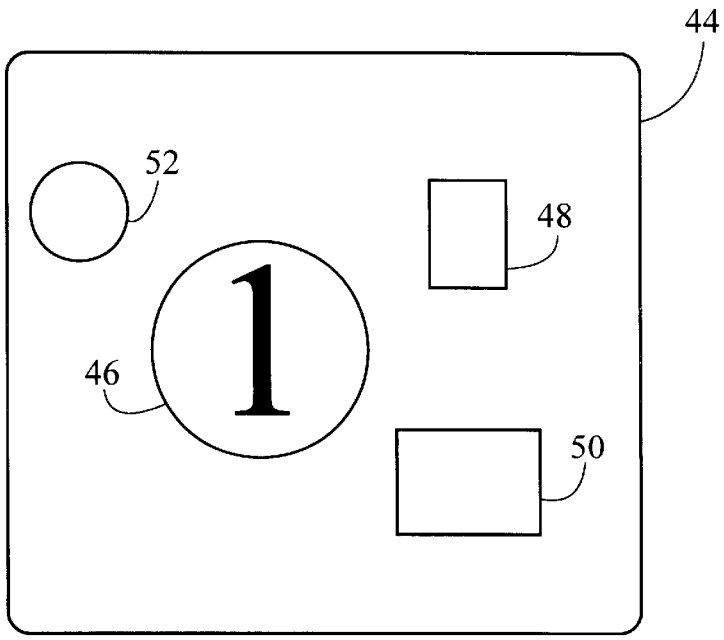
FIG. 3 is an enlarged top plan view of a playing area.

FIG. 3 is an enlarged top plan view of playing area 44. Playing area 44 includes conventional wager (betting) circle 46, discarded playing piece circle 48, set playing piece (hand) circle 50, and bonus wager circle 52.

FIG. 4 is a flow diagram illustrating the method of playing the wagering game of the present invention, generally designated as 100.

Wagering game 100 begins with step (START) which starts a round of play.

In step (a) at least two players are provided, wherein one of the players is a house dealer. The house dealer represents the house, gaming establishment, or casino, and all wagers won by the house dealer go to the house. In the present invention, the house dealer (1) is a player and participates in playing the game, (2) shuffles and deals the playing pieces, (3) when banker, compares hands and settles wagers, and (4) generally controls play of the game. This is unlike California games where the house dealer does not participate as a player in the game. The present game is designed for a maximum of eight players, including seven outside players and the house dealer.

In step (b) a set of 30 playing playing pieces is provided, the set includes three playing pieces having a numerical value of one 22, three playing pieces having a numerical value of two 24, three playing pieces having a numerical value of three 26, three playing pieces having a numerical value of four 28, three playing pieces having a numerical value of five 30, three playing pieces having a numerical value of six 32, three playing pieces having a numerical value of seven 34, three playing pieces having a numerical value of eight 36, three playing pieces having a numerical value of nine 38, and three playing pieces having a numerical value of zero 40.

In step (c) one of the players is selected as a banker. During a round of play, the banker plays against all of the other players. In one embodiment, and in keeping with common gaming practice, for the first round of play, the house dealer assumes the role of banker. After the first round of play is completed, the house dealer sequentially offers the banker role to each other player until one player accepts. If no other player accepts the bank, the house dealer becomes the banker for the next round of play. After the next round of play is completed, the offering process is repeated. In another embodiment, and in keeping with common gaming practice, after each round of play wherein a player (outside player) other than the house dealer was the banker, the banker role is sequentially offered to each other player until one player accepts, else the house dealer becoming the banker for the next round of play. And, in another embodiment, and in keeping with common gaming practice, after each round of play wherein a player other than the house dealer was banker, the house dealer becomes the banker for the next round of play. In practice, the house dealer will always accept the bank, since the house has a slightly greater advantage do to the fact that the banker takes pushes (see step (i) below). Also, in a preferred embodiment, a player other than the house dealer is not allowed to bank for two successive rounds of play.

In step (d) each player except the selected banker places a wager (conventional). The wager is the amount which the player can win or lose from the banker. In a preferred embodiment of the present invention, each player except the house dealer can optionally place a bonus wager, provided the player (except the banker) has placed a wager. That is, all players other than the house dealer can place a bonus wager, provided that is if they are not the banker they have also placed a conventional wager. Since the banker does not place a conventional wager, the banker is always permitted to place a bonus wager.

If a bonus wager is placed, the player wins a house bonus payoff (a payoff made by the house) if in step (e) (see below) the player is dealt three playing pieces having the same numerical value (three of a kind). A preferred house bonus payoff for three playing pieces having the same numerical value is 40 to 1. That is, for a one unit bonus wager the player keeps the one unit and wins 40 additional units from the house. If the player does not have three playing pieces having the same numerical value, the player wins a house bonus payoff if in step (e) the player is dealt three playing pieces which when summed result in a least significant digit (LSD) of 9. Put in mathematical terms, the sum of the playing pieces is computed modulo 10. Put another way, a house bonus payoff is made if the player's playing pieces sum to 9 or 19. A preferred house bonus payoff for three playing piece which when summed result in a LSD of 9 is 4 to 1. If the player does not have three playing pieces having the same numerical value, and does not have three playing pieces which when summed result in a LSD of 9, the player wins a house bonus payoff if in step (e) the player is dealt two playing pieces which have the same numerical value (a pair). A preferred house bonus payoff for two playing pieces which have the same numerical value is 1to 1. It is emphasized that while three bonus payoff are possible, these payoffs are mutually exclusive and only one bonus payoff can be won. For example, if a player has placed a bonus wager and is dealt three three value playing pieces, he or she only wins the bonus for three playing pieces of the same numerical value, and not also the bonus for three playing pieces whose sum has an LSD of 9, nor the bonus for two playing pieces which have the same numerical value. It is further noted, that a player can win a bonus wager even if they lose the conventional wager.

In step (e) the house dealer deals (distributes) three playing pieces to each player. In a preferred embodiment, before step (e), the house dealer places the playing pieces in ten groups (such as stacks) containing three playing pieces each. Dice are then rolled to determine which group is dealt first, the first group being dealt to the banker.

In step (f) each player sets his or her hand by selecting two of the three dealt playing pieces and discarding one of the three dealt playing pieces;

In step (g) the two selected playing pieces of step (f) include a ranking from highest to lowest of:

two zero value playing pieces;

two nine value playing pieces;

two eight value playing pieces;

two seven value playing pieces;

two six value playing pieces;

two five value playing pieces;

two four value playing pieces;

two three value playing pieces;

two two value playing pieces;

two one value playing pieces;

two different value playing pieces which when summed result in a LSD of nine;

two different value playing pieces which when summed result in a LSD of eight;

two different value playing pieces which when summed result in a LSD of seven;

two different value playing pieces which when summed result in a LSD of six;

two different value playing pieces which when summed result in a LSD of five;

two different value playing pieces which when summed result in a LSD of four; and, two different value playing pieces which when summed result in a LSD of three;

For example, if the player's two playing piece hand contains a 9 and an 8, the sum would be 17 and the LSD would be 7.

It is noted that the worst three playing pieces that a player can be dealt in step (e) is a one playing piece, a two playing piece, and a zero playing piece. With such a hand, the player can only discard the zero playing piece and keep the one and two playing pieces for a summed LSD of three. However, if a player makes a mistake in setting his or her hand, it is possible that the summed LSDs of two, one, or zero can be achieved in a two playing piece hand. For example if a player is dealt a six, a four, and a three, and mistakenly discards the three, the summed LSD will be zero. Therefore to accommodate such situations, after two different value playing pieces which when summed result in a LSD of three, the hand rankings must also include;

two different value playing pieces which when summed result in a LSD of two;

two different value playing pieces which when summed result in a LSD of one; and, two different value playing pieces which when summed result in a LSD of zero.

In step (h) the banker sequentially compares his or her hand with the hand of each of the other players. In a preferred embodiment, and in keeping with common gaming practice, the banker first compares hands with the house dealer, and then sequentially compares hands with the other players. In a preferred embodiment, the other player comparison process starts with the player on the banker's right an proceeds counterclockwise.

In step (i) for each step (h) comparison, the player (banker or other player) having the highest ranking hand as defined in step (g) wins the wager of the other player. In a preferred embodiment, in step (i), if the two players have two different value playing pieces which when summed result in the same LSD, the player having the highest ranking single playing piece wins the wager. The zero value playing piece is the highest ranking, progressing to the one value playing piece which is the lowest ranking. In another preferred embodiment, in step (i), if the two players have identical hands, banker wins the wager of the other player. That is, the banker takes pushes.

In step (j), (1) if the house dealer is banker, a fixed percentage of each wager won in step (i) goes to (is taken by) the house dealer, and therefore the house, or (2) if an outside player is banker, a fixed percentage of the banker's net winnings from step (i) go to the house dealer. This percentage compensates the house for the expense of conducting the game. In a preferred embodiment in step (j), the fixed percentage taken by the house is five %. In some instances, the amount of the wager is rounded upward before taking the five % to result in a convenient amount considering the value of the chips being used. It may be appreciated that other house percentages may be utilized in the present invention to adjust the amount of house profit.

Wagering game 100 concludes with step (END) which ends a round of play.

It is further noted that game 100 may be played in person in a casino environment, or remotely over any suitable communications link such as the internet, LAN, WAN, etc.

FIG. 5 is a flow diagram of a second embodiment of the present invention, generally designated as 200. Game 200 is almost identical to game 100 except (1) a bonus wager is included, and the house fixed % is eliminated.

SAMPLE ROUND OF PLAY #1 (Player #5 is Banker)

| Player: | $Wager | $Bonus Wager | 3 Dealt Playing Pieces | Set Hand |
|---|---|---|---|---|
| #1 | 100 | 20 | 1, 6, 7 | 1, 7 |
| #2 | 500 | 50 | 3, 5, 9 | 3, 5 |
| #3 | 200 | 20 | 2, 2, 2 | 2, 2 |
| #5 (Banker) | n/a | 50 | 3, 8, 0 | 8, 0 |
| #6 | 100 | 20 | 3, 9, 0 | 9, 0 |
| #7 | 300 | none | 4, 4, 6 | 4, 4 |
| #8 | 100 | 40 | 1, 8, 0 | 1, 8 |
| House Dealer | 300 | n/a | 4, 8, 0 | 8, 0 |

Analysis Round #1(After the House Dealer, comparisons start with Player #6 and proceed ccw)

House/—loses Wager of 300 to the Banker (Banker takes pushes) Dealer

Player #6—wins Wager of 100 from the Banker (LSD 9 v. 8)

loses Bonus Wager of 20 to house

Player #7—wins Wager of 300 from the Banker (pair of 4's)

would have won Bonus Wager for pair of 4s, but did not bet

Player #8—wins Wager of 100 from the Banker (LSD 9 v. 8)

wins Bonus Wager of 160 (40×4) from house (LSD 9)

Player #1—loses Wager of 100 to the Banker (high playing piece 7 v. 0)

loses Bonus Wager of 20 to house

Player #2—loses Wager of 500 to the Banker (high playing piece 5 v. 0)

loses Bonus Wager of 50 to house

Player #3—wins Wager of 200 from the Banker (pair of 2's)

wins Bonus Wager of 800 (20×40) from house (three 2's)

Player #5—loses Bonus Wager of 50 to house

TOTAL NET BANKER WINNINGS—$200

5% HOUSE PERCENTAGE—$10

SAMPLE ROUND OF PLAY #2 (House Dealer is Banker)

| Player: | $Wager | $Bonus Wager | 3 Dealt Playing Pieces | Set Hand |
|---|---|---|---|---|
| #1 | 100 | 20 | 2, 8, 9 | 8, 9 |
| #2 | 200 | 50 | 2, 9, 0 | 2, 9* |
| #3 | 200 | 20 | 1, 1, 7 | 1, 1 |
| #5 | 400 | none | 1, 6, 7 | 1, 7 |
| #6 | 100 | 20 | 4, 9, 0 | 9, 0 |
| #7 | 300 | none | 3, 6, 0 | 3, 6 |
| #8 | 100 | 40 | 5, 6, 7 | 6, 7 |
| House Dealer (Banker) | n/a | n/a | 3, 6, 7 | 3, 6 |

*Player #2 incorrectly set hand, should have been 9, 0

Analysis Round #2 (Comparisons start with Player #1 and proceed ccw)

Player #1—loses Wager of 100) to the Banker (LSD 7 v.9)

wins Bonus Wager of 80 (20×4) from house (LSD of 9)

Player #2—loses Wager of 200 to the Banker (LSD 1 v.9)

loses Bonus Wager of 50 to house

Player #3—wins Wager of 190 (200–5%) from the Banker (pair of 1's)

wins Bonus Wager of 20 (20×1) from house (pair of 1's)

Player #5—loses Wager of 400 (LSD 8 v. 9)

Player #6—wins Wager of 95 (100–5%) from the Banker (high playing piece 0 v. 6)

loses Bonus Wager of 20 to house

Player #7—loses Wager of 300 to Banker (Banker takes pushes)

would have won Bonus Wager for LSD of 9, but did not bet

Player #8—loses Wager of 100 to the Banker (LSD 3 v.9)

loses Bonus Wager of 40 to house

The preferred embodiments of the invention described herein are exemplary and numerous modifications, playing variations, and rearrangements can be readily envisioned to achieve an equivalent result, all of which are intended to be embraced within the scope of the appended claims.

I claim:

1. A method of playing a wagering game, comprising:

(a) providing at least two players, one of said players being a house dealer;

(b) providing a set of 30 playing pieces, said set including three playing pieces having a numerical value of one, three playing pieces having a numerical value of two, three playing pieces having a numerical value of three, three playing pieces having a numerical value of four, three playing pieces having a numerical value of five, three playing pieces having a numerical value of six, three playing pieces having a numerical value of seven, three playing pieces having a numerical value of eight, three playing pieces having a numerical value of nine, and three playing pieces having a numerical value of zero;

(c) selecting one of said players as a banker;

(d) each said player except said banker placing a wager;

(e) said house dealer randomizing said playing pieces and dealing three playing pieces to each said player;

(f) each said player setting his or her hand by selecting two of said three playing pieces and discarding one of said three playing pieces;

(g) said two selected playing pieces of step (f) including a ranking from highest to lowest of:
two said zero value playing pieces;
two said nine value playing pieces;
two said eight value playing pieces;
two said seven value playing pieces;
two said six value playing pieces;
two said five value playing pieces;
two said four value playing pieces;
two said three value playing pieces;
two said two value playing pieces;
two said one value playing pieces;
two different value playing pieces which when summed result in a LSD of nine;
two different value playing pieces which when summed result in a LSD of eight;
two different value playing pieces which when summed result in a LSD of seven;
two different value playing pieces which when summed result in a LSD;
two different value playing pieces which when summed result in a LSD of five;
two different value playing pieces which when summed result in a LSD of four; and,
two different value playing pieces which when summed result in a LSD of three;

(h) said banker comparing hands with each of said other players;

(i) in each step (h) comparison, said player having a highest ranking hand as defined in step (g) winning said wager of said other player;

(i) (1) if said house dealer is banker, a fixed percentage of each said wager won in step (i) going to said house dealer, or (2) if an outside player is banker, a fixed percentage of said banker's net winnings from step (i) going to said house dealer; and, in step (d), each said player except said house dealer optionally placing a bonus wager, provided said player except said banker has placed a wager, said player winning a house bonus payoff if in step (e) said player is dealt three playing pieces having the same numerical value.

2. The method according to claim 1, further including:

if said player does not have three playing pieces having the same numerical value, said player winning a house bonus payoff if in step(e) said player is dealt three playing pieces which when summed result in a LSD of 9.

3. The method according to claim 2, further including:

if said player does not have three playing pieces having the same numerical value, and does not have three playing pieces which when summed result in a LSD of 9, said player winning a house bonus payoff if in step (e) said player is dealt two playing pieces which have the same numerical value.

4. A method of playing a wagering game, comprising:

(a) providing at least two players, one of said players being a house dealer;

(b) providing a set of 30 playing pieces, said set including three playing pieces having a numerical value of one, three playing pieces having a numerical value of two, three playing pieces having a numerical value of three, three playing pieces having a numerical value of four, three playing pieces having a numerical value of five, three playing pieces having a numerical value of six, three playing pieces having a numerical value of seven, three playing pieces having a numerical value of eight, three playing pieces having a numerical value of nine, and three playing pieces having a numerical value of zero;

(c) selecting one of said players as a banker;

(d) each said player except said banker placing a wager;

(e) said house dealer randomizing said playing pieces and dealing three playing pieces to each said player;

(f) each said player setting his or her hand by selecting two of said three playing pieces and discarding one of said three playing pieces;

(g) said two selected playing pieces of step (f) including a ranking from highest to lowest of:
two said zero value playing pieces;
two said nine value playing pieces;
two said eight value playing pieces;
two said seven value playing pieces;
two said six value playing pieces;
two said five value playing pieces;
two said four value playing pieces;
two said three value playing pieces;
two said two value playing pieces;
two said one value playing pieces;
two different value playing pieces which when summed result in a LSD of nine;
two different value playing pieces which when summed result in a LSD of eight;
two different value playing pieces which when summed result in a LSD of seven;
two different value playing pieces which when summed result in a LSD of six;
two different value playing pieces which when summed result in a LSD of five;
two different value playing pieces which when summed result in a LSD of four; and,
two different value playing pieces which when summed result in a LSD of three;

(h) said banker comparing hands with each of said other players;

(i) in each step (h) comparison, said player having a highest ranking hand as defined in step (g) winning said wager of said other player;

(j) (1) if said house dealer is banker, a fixed percentage of each said wager won in step (i) going to said house dealer, or (2) if an outside player is banker, a fixed percentage of said banker's net winnings from step (i) going to said house dealer;

in step (g), after two different value playing pieces which when summed result in a LSD of three, said ranking also including;

two different value playing pieces which when summed result in a LSD of two;

two different value playing pieces which when summed result in a LSD of one; and, two different value playing pieces which when summed result in a LSD of zero.

5. A method of playing a wagering game, comprising:

(a) providing at least two players, one of said players being a house dealer;

(b) providing a set of 30 playing pieces, said set including three playing pieces having a numerical value of one, three playing pieces having a numerical value of two, three playing pieces having a numerical value of three, three playing pieces having a numerical value of four, three playing pieces having a numerical value of five, three playing pieces having a numerical value of six, three playing pieces having a numerical value of seven, three playing pieces having a numerical value of eight, three playing pieces having a numerical value of nine, and three playing pieces having a numerical value of zero;

(c) selecting one of said players as a banker;

(d) each said player except said banker placing a wager, and each said player except said house dealer optionally placing a bonus wager, provided said player except said banker has placed a wager;

(e) said house dealer randomizing said playing pieces and dealing three playing pieces to each said player;

(f) each said player setting his or her hand by selecting two of said three playing pieces and discarding one of said three playing pieces;

(g) said two selected playing pieces of step (g) including a ranking from highest to lowest of:

two said zero value playing pieces;

two said nine value playing pieces;

two said eight value playing pieces;

two said seven value playing pieces;

two said six value playing pieces;

two said five value playing pieces;

two said four value playing pieces;

two said three value playing pieces;

two said two value playing pieces;

two said one value playing pieces;

two different value playing pieces which when summed result in a LSD of nine;

two different value playing pieces which when summed result in a LSD of eight;

two different value playing pieces which when summed result in a LSD of seven;

two different value playing pieces which when summed result in a LSD of six;

two different value playing pieces which when summed result in a LSD of five;

two different value playing pieces which when summed result in a LSD of four; and, two different value playing pieces which when summed result in a LSD of three;

(h) said banker comparing hands with each of said other players;

(i) in each step (h) comparison, said player having a highest ranking hand as defined in step (g) winning said wager of said other player;

(j) each said player winning a house bonus payoff if in step (e) if said player is dealt three playing pieces having the same numerical value, else said player winning a house bonus playoff if said player is dealt three playing pieces which when summed result in a LSD of 9, else said player winning a bonus payoff if said player is dealt two playing pieces which have the same numerical value;

in step (g), after two different value playing pieces which when summed result in a LSD of three, said ranking also including;

two different value playing pieces which when summed result in a LSD of two;

two different value playing pieces which when summed result in a LSD of one; and, two different value playing pieces which when summed result in a LSD of zero.

* * * * *